United States Patent [19]

Marforio

[11] 4,044,699

[45] Aug. 30, 1977

[54] DEVICE FOR TILTING SEWING MACHINE HOOKS TO FACILITATE THREADING

[75] Inventor: Nerino Marforio, Milan, Italy

[73] Assignee: Rockwell-Rimoldi S.p.A., Milan, Italy

[21] Appl. No.: 721,621

[22] Filed: Sept. 8, 1976

[30] Foreign Application Priority Data

Sept. 23, 1975 Italy ..... 27523/75

[51] Int. Cl.[2] ..... D05B 57/02

[52] U.S. Cl. ..... 112/200

[58] Field of Search ..... 112/166, 197, 198, 200, 112/199

[56] References Cited

U.S. PATENT DOCUMENTS

| | | | |
|---|---|---|---|
| 2,239,591 | 4/1941 | Clayton | 112/200 |
| 2,397,336 | 3/1946 | Clayton | 112/200 |
| 2,636,463 | 4/1953 | Quist | 112/200 |
| 2,758,557 | 8/1956 | Moecke | 112/200 |

*Primary Examiner*—George H. Krizmanich

[57] ABSTRACT

A device for selectively displacing sewing machine hooks to a position whereat they are readily accessible to an operator for threading purposes. The device includes a lever member pivotably mounted on the shaft which supports the hooks and an arm in the form of a cylindrical seat fixed on the shaft which carries a spring biased pin that is continuously urged into driving engagement with the lever member to effect oscillating movement of the shaft. A manually operable member is provided for disengaging the pin from driving engagement with the lever which permits the shaft to be rotated to a position that places the hooks carried thereby in an accessible position.

5 Claims, 5 Drawing Figures

Fig. 5
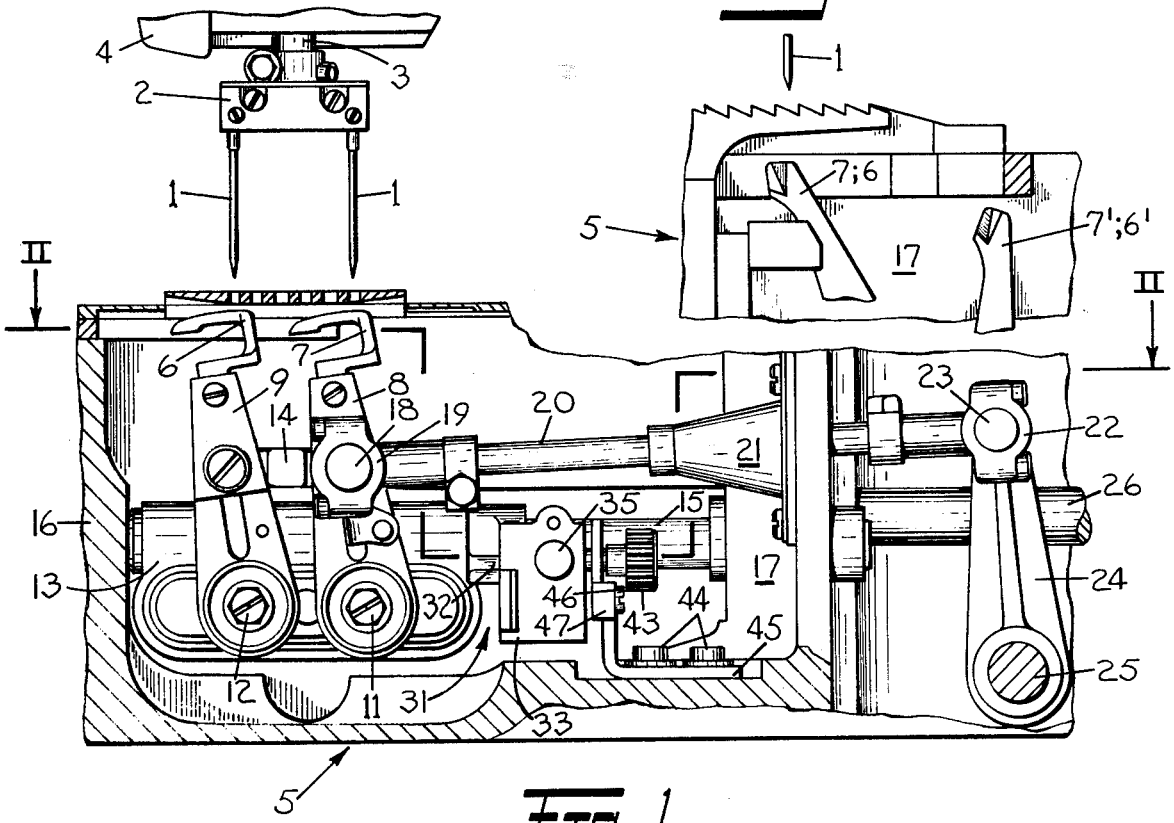
Fig. 1
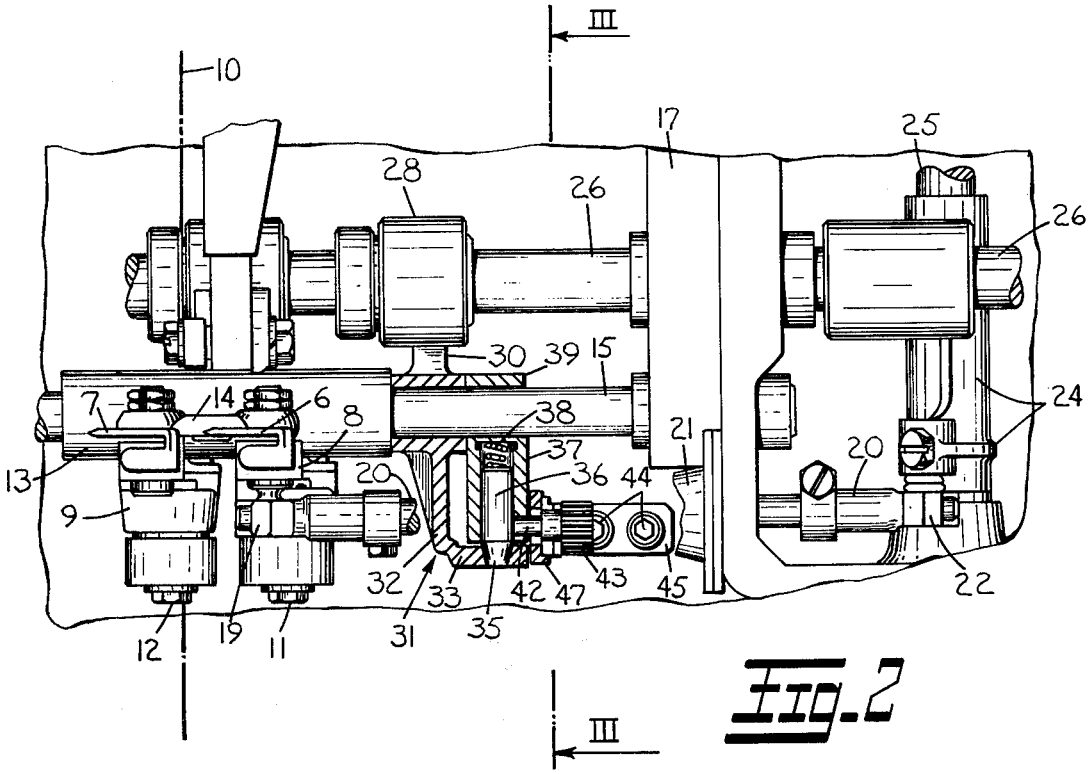
Fig. 2

DEVICE FOR TILTING SEWING MACHINE HOOKS TO FACILITATE THREADING

BACKGROUND OF THE INVENTION

The present invention relates to a device for tilting sewing machine hooks to facilitate the threading operation.

In addition to the normal upper sewing elements, conventional sewing machines which sew one or more parallel chain-stitched seams are also provided with one or more hooks which are displaced in a longitudinal movement at right angles to the direction of advancement of the article being sewn and in a transversal movement parallel to the direction of advancement.

In the case of multi-needle chain-stitch sewing machines, the number of hooks corresponds to the number of needles and they can be disposed either parallel to the direction of advancement or transversally thereto.

In the case of the known types of multi-needle sewing machines, considerable difficulty has been experienced in threading the hooks, either because the latter, for reasons of space, are completely or partially concealed by other parts of the machine or because they are disposed side by side in a position which is not easily accessible to the operator.

This difficulty is most aggravated in sewing machines provided with four needles, wherein one of the most commonly employed hook arrangements is that known as the "tandem" arrangement in which hooks are mounted side by side in pairs and in two separate planes on a shaft pivoting about its own axis and which are disposed transversally relative to the direction of advancement of the article being sewn.

With conventional four needle sewing machines having the tandem hook arrangement, considerable difficulty has been experienced in threading the hooks, particularly the rear hooks, as they are practically concealed by the front hooks.

A considerable amount of time is lost in threading the hooks which results in what is considered a substantial loss in production with this type of sewing machine.

To simplify respresentation thereof, and for purpose of brevity specific reference will only be made hereinafter to a machine having two hooks.

OBJECT OF THE INVENTION

The object of the present invention is to provide a means which will facilitate the threading of the hooks, and reduce the time required for this operation.

The technical problem to be solved is that of being able to bring the hooks into a forward position whereat they are readily accessible to the operator for the purpose of carrying out the threading operation by simply tilting the hooks per se towards the operator, and of being able to return the hooks to their operating after they have been threaded, without requiring any special mechanical operations.

SUMMARY OF THE INVENTION

The above technical problem is solved by the device according to the present invention which is adapted to tilt the hooks of a sewing machine which permits displacement of the hooks in a longitudinal direction at right angles to the direction of advancement of the article to be sewn as well as displacement of the hooks in a transversal direction parallel to the direction of advancement of said article. These hooks are supported on an oscillatable hook supporting shaft and the device includes a member pivotally mounted on the supporting shaft and an element fixed on means pivotable about a hook-bearing pivoting shaft, an element integral with said shaft for movement therewith. A selectively releasable connection means is adapted to rigidly connect the pivotally mounted member to the element fixed on the shaft which is caused to pivot on its axis. A retaining means operatively associated with the connection means permits the latter to be released only when the connection means is located is a position corresponding to that of the upper needle position.

In addition to rendering the hooks easily acessible for the purpose of threading the same, the device according to the invention also has the advantage of preventing the needles from being stressed or broken as a result of the hooks striking against the needles, should the hooks be moved into the threading position when the needles are disposed at the lower portion of their stroke.

These and other features of the invention will be made apparent in the course of the following detailed description of two preferred embodiments thereof, provided by way of non-limitative examples and with reference to the accompanying drawings, in which:

BRIEF DESCRIPTION OF THE DRAWINGS

FIG. 1 is a partial front view of a sewing machine equipped with a first embodiment of a device according to the invention;

FIG. 2 is a plan view of part of the sewing machine showing a section of only the device according to the invention along line II—11 in FIG.1;

FIG. 5 is a partial side view of the positions of the hooks in their operating position and in the threading position.

DESCRIPTION OF THE PREFERRED EMBODIMENT

Figure 3:
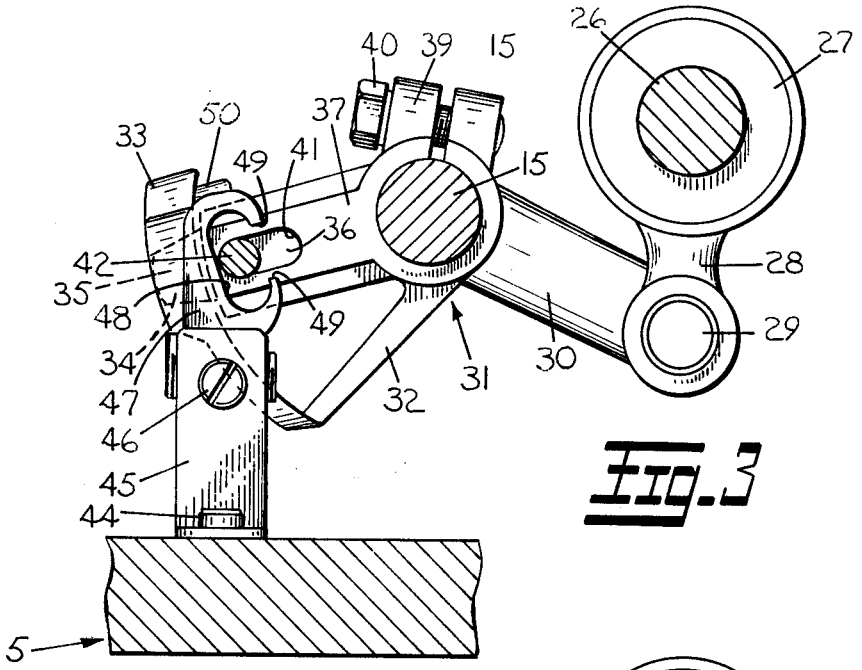
FIG. 3 shows a partial sectional side view of the sewing machine along line III—III in FIG. 2.

Referring now to FIG. 1 the sewing machine equipped with the device according to the invention includes two needles 1 supported by a clamp 2 that is attached to the lower end of a needle bar 3 slidably mounted in the head 4 which is supported in a projecting manner by a conventional arm (not shown). This arm is supported by an upright that is connected to the base 5 which accommodates, inter alia, two hooks 6 and 7 and the associated operating means.

The hooks 6 and 7 are mounted on supports 8 and 9 respectively, which are disposed transversally to the direction of advancement of a workpiece as indicated by line 10 in FIG. 2.

The supports 8 and 9 are pivotally mounted at 11 and 12 respectively, on a sleeve 13 and are interconnected in a conventional manner by a connecting rod 14 (FIG. 1).

The sleeve 13 is fixed on an oscillatable hook supporting shaft 15 the ends of which are journalled in spaced walls 16 and 17 that extend upwardly from the base 5 of the machine.

The head 19 of a rod 20 is connected to the support 8 by means of a spherical pin 18. The rod 20 extends through an oil sleeve 21 and beyond wall 17 where it is connected by means of a head 22 and spherical pin 23 to a lever 24. The lower end of lever 24 is fixed, as shown in FIG. 1, to an oscillatably driven shaft 25.

The oscillating movement of the shaft 25 is effected by conventional means (not shown) from the main shaft 26 which in a known manner is rotatably driven.

The rod thus causes the hooks to reciprocate in a longitudinal direction perpendicular to the direction of advancement indicated by numeral 10 in FIG. 2.

As is more clearly shown in FIG. 3, an eccentric 27 is fixed on the main shaft 26 and includes an associated lever 28 pivotally connected at 29 to an arm 30 of a double armed lever 31 that is pivotably mounted on the shaft 15. This lever 31 constitutes a pivoting means and is provided with another arm 32 having a segment 33 disposed coaxial to the axis of the shaft 15 which includes a radial bore 34, into which the tip 35 of a pin 36 is insertable. Pin 36 is slidably carried within an actuating means that defines a cylindrical seat 37 and is biased in the direction of the radial bore by a coil spring 38 as shown in FIG. 2.

The end of the cylindrical seat 37, from which the pin 36 projects, has the same curvature as the segment 33, and the opposite end defines a clamp 39 which is tightened by means of a screw 40 on the shaft 15. The cylindrical seat 37 also includes a longitudinal slot 41 from which a stem 42 extends. One end of this stem 42 is attached to the pin 36 and the opposite end has a knob 43 assembled thereon.

A support bracket 45 is attached to the base of the machine by means of screws 44. A plate 47 is adjustably attached to the upper end of the support bracket 45 and includes an open slot 48 within which the stem 42 is adapted to pivot. The opening into the open slot 48 is identified by numeral 49 and is of a size approximately equal to the diameter of the stem 42.

The device according to the invention operates in the following manner. When it is necessary to thread the hooks, the knob 43 is pushed to overcome the biasing force of spring 38, and until the tip 35 of the pin 36 is moved out of the bore 34 of the segment 33.

At this point, the sleeve 13 and thus the hook supports are free to rotate towards the outside of the machine as shown in FIG. 5, in which the two hooks 6 and 7 are shown in their operating position and the same hooks, designated by 6' and 7', are shown in the threading position whereat they are disposed in a position accessible to the operator.

The hooks are pivoted by the operator to the threading position after the tip 35 has been disengaged from the segment 33. This is facilitated owing to the fact that the hooks are being moved relative to the axis of the shaft 15 and they tend to rotate through the action of gravity. The displacement of the pin 36 in the cylindrical seat 37 is only possible when the stem 42 is in a position that is in alignment with the opening 49. Obtaining this position is only possible when the needles of the sewing machine are located at the upper end of their stroke. The needle bar 3 is operatively connected to the shaft 15 by conventional means (not shown) that are actuated by the main shaft 26.

When the needles are in any other position the stem 42 is engaged in the open slot 48 and thus the pin 36 cannot be displaced which prevents the hooks from being tilted towards the outside of the machine.

The hooks can only be tilted when the needles are located at the upper end of their stroke for any other position would create an interference when attempting to tilt the hooks that could result in either damage to or breakage of the needles.

After the hooks have been threaded, they are pushed back manually towards their operating position until the tip 35 sliding along the segment 33 again enters the bore 34. A stop 50 (FIG. 3) is provided on the upper part of the segment 33 to restrict movement of the cylindrical seat 37 and prevent the tip 35 from missing the bore 34 as a result of an over rapid movement of the hooks.

Figure 4:
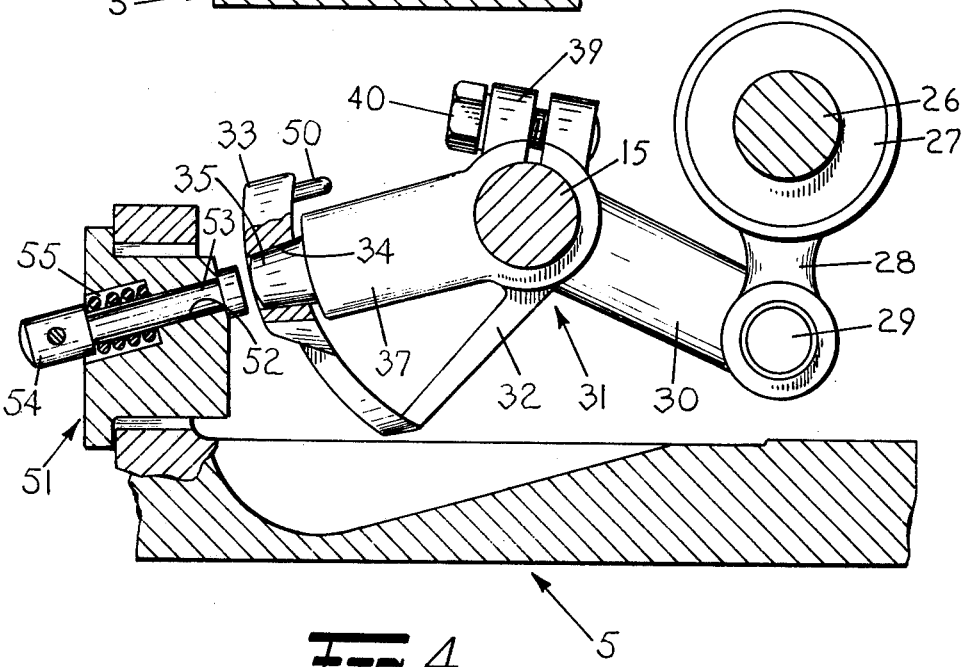
FIG. 4 shows the same view of the sewing machine according to FIG. 3 equipped with a second embodiment of the device according to the invention.

A modification of the invention is shown in FIG. 4 which includes a support bracket fixedly mounted on the sewing machine base. This support bracket 51 is provided with a bore 52 within which a pin 53 having a push knob 54 and a return spring 55 is adapted to slide.

The pin 53 is coaxial with the tip 35 of the pin 36 (FIG. 2) only when the needles are situated at the upper end of their stroke and thus by pressing on the push knob 54 it can be pressed against tip 35 until it is removed from the bore 34 of the segment 33.

Although the present invention has been described in connection with a preferred embodiment, it is to be understood that modifications and variations may be resorted to without departing from the spirit and scope of the invention as those skilled in the art will readily understand. Such modifications and variations are considered to be within the purview and scope of the invention and the appended claims.

I claim:

1. A device for tilting the hooks within the base of a sewing machine of the type having needles operatively associated with the hooks for forming chain stitches, said device comprising:

a. a hook supporting shaft (15) oscillatably supported within the base of the sewing machine;

b. a lever member (31) pivotally mounted on said hook supporting shaft which includes:

i. an arm (32) having a segment (33) formed on the free end thereof, said segment being concentric to said hook supporting shaft (15) and including means on the inner surface thereof defining a radial bore (34);

c. actuating means (37) fixed on said hook supporting shaft in operative association with said lever member;

d. a pin (36) slidably carried by said actuating means for connecting said lever member (31) with said actuating means (37) to effect oscillating movement of said hook supporting shaft (15); and e. means for selectively disconnecting said lever member (31) from said actuating means (37) to permit tilting of the hooks to a position to facilitate the threading thereof.

2. The device according to claim 1 wherein said actuating means (37) defines a cylindrical seat within which said pin (36) is slidably assembled.

3. The device according to claim 2 wherein said pin includes a tip (35) and a coil spring (38) operatively associated with said pin for continuously urging said tip (35) in the direction of said radial bore (34).

4. The device according to claim 3 wherein said disconnecting means includes a stem (42) fixed to and extending from said pin (36) in a plane normal to the axis thereof for selectively moving said tip (35) out of said radial bore (34) when the needles are located at the upper end of their stroke.

5. The device according to claim 3 wherein said disconnecting means includes a spring biased pin (53) selectively movable in a longitudinal direction, when the needles are located at the upper end of their stroke, to engage and move said tip (35) out of said radial bore (34).

* * * * *

UNITED STATES PATENT AND TRADEMARK OFFICE

CERTIFICATE OF CORRECTION

PATENT NO. : 4,044,699

DATED : August 30, 1977

INVENTOR(S) : Nerino Marforio

It is certified that error appears in the above-identified patent and that said Letters Patent are hereby corrected as shown below:

Column 1, Line 56, after "operating" insert --position--.

Signed and Sealed this

*Seventh* Day of *February 1978*

[SEAL]

*Attest:*

RUTH C. MASON
*Attesting Officer*

LUTRELLE F. PARKER
*Acting Commissioner of Patents and Trademarks*